US005815964A

United States Patent [19]

Douglas

[11] Patent Number: 5,815,964

[45] Date of Patent: Oct. 6, 1998

[54] HIDDEN MESSAGE GREETING CARD

[76] Inventor: Roy S. Douglas, 1135 Rte. 245, Apt. B, Middlesex, N.Y. 14507

[21] Appl. No.: 708,755

[22] Filed: Sep. 9, 1996

[51] Int. Cl.[6] ..... G09F 1/00

[52] U.S. Cl. ..... 40/124.12; 40/486; 283/117

[58] Field of Search ..... 40/124.09, 124.11, 40/124.12, 486, 492; 283/106, 117; 273/153 R, 272; 434/177, 364

[56] References Cited

U.S. PATENT DOCUMENTS

| | | | |
|---|---|---|---|
| 1,642,424 | 9/1927 | Massey | 273/153 R |
| 2,517,115 | 8/1950 | Kelly | 283/117 |
| 4,512,581 | 4/1985 | Levine | 283/103 X |
| 4,595,203 | 6/1986 | DeLano et al. | 273/153 R X |
| 4,728,294 | 3/1988 | Bredehorn | 273/153 R X |
| 4,826,211 | 5/1989 | Sinnott et al. | 283/117 |
| 5,261,703 | 11/1993 | Lenkoff | 40/124.11 X |

*Primary Examiner*—Brian K. Green
*Attorney, Agent, or Firm*—Cumpston & Shaw

[57] ABSTRACT

A greeting card kit which includes a greeting card containing a "hidden message." The greeting card includes an imprinted crossword puzzle type lattice having open squares and spaced numbers each keyed to either an "across" or a "down" heading. A recipient of the greeting card solves the crossword puzzle using clues and deciphers the hidden message through a mask of the greeting card.

3 Claims, 8 Drawing Sheets

ACROSS

1. Some unmarried girls dream about their _____ day.
3. Egg ___ is a favorite holiday drink.
6. Daniel found himself in the Lion's ___.
7. No checks or credit cards! You must pay ____.
9. Opposite of "oldster".
11. I _____ all of the questions on the test correctly.
13. Another word for globe, ball, or orb: The equator divides the world into a northern and Southern Hemi _____.

DOWN

1. Beer comes from a brewery, and wine comes from a_____.
2. What you do with a shovel.
4. Opposite of "off".
5. Past tense of "Sing".
8. The Slugger ___ a home run.
10. They're a perfect match: HE NEEDS HER AND SHE NEEDS TO BE _____.
12. That part of you that smells, and I don't Mean your feet.

24

*Answers on back of card*

46

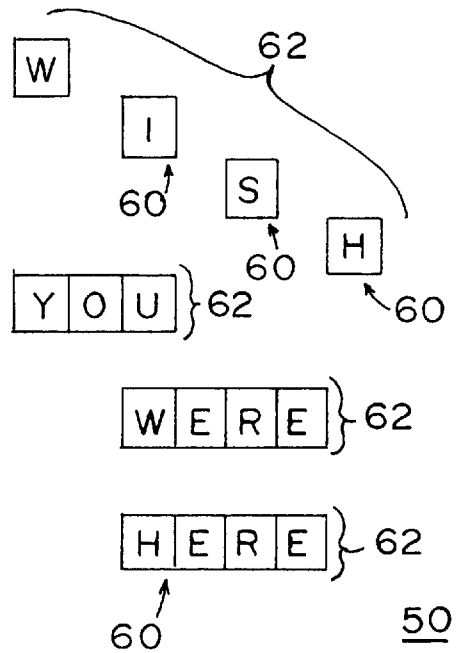

10

FIG. 9

HIDDEN MESSAGE GREETING CARD

FIELD OF THE INVENTION

This invention relates generally to birthday, Christmas, and other types of greeting or holiday cards, and more specifically to greeting cards which, in cooperation with a puzzle or poem, relay or express a "message" to the card recipient.

BACKGROUND OF THE INVENTION

Many types of greeting cards for many different events or occasions are known and widely distributed in exchange. Such cards include birthday greetings, anniversary congratulations, "get well" cards, holiday greetings, and cards for graduations and confirmations, and many others. Greeting cards have become ever more popular and the competition among manufacturers of such cards has led to a proliferation of cards for virtually every imaginable occasion. The search for evermore clever and attention getting devices with such cards has resulted in virtually every imaginable preprinted message with such cards, and some manufacturers have invented various foldout or other non-planar cards in order to provide further entertainment for the recipient when the card is opened.

Puzzles are a popular avocation with many people, particularly the type known as crossword puzzles in which an individual completes the crossword puzzle with the use of clues, definitions, and so on. However, heretofore, the desirability of interrelating greeting cards and puzzles has not been generally recognized and greeting cards and puzzles have seldom been combined to effect a single special purpose. Relatively little has been accomplished in combining the above two fields. Specifically, greeting cards which, in cooperation with the puzzle, relay or express a "message" to the card recipient are relatively rare, if in existence at all.

SUMMARY OF THE INVENTION

The present invention relates to a greeting card. The principal aim of the present invention is, through a novel approach, to provide, for a single purpose, a unitary assembly consisting of a puzzle or poem integrated with a greeting card. The kit contains a "hidden message" physically accompanying but sequestered on a greeting card. The present invention includes a greeting card comprising a poem or a puzzle having as its solution, a first plurality of words; and a mask for revealing a plurality of letters from the first plurality of words for forming a greeting consisting of a second plurality of words different from the first plurality of words.

As an alternative embodiment of the invention, the first plurality of words may be included as part of the text of a poem, greeting or paragraph.

As an alternative embodiment of the invention, the correct completed solution to the crossword puzzle may be reproduced on a image transferable sheet removably contained in the kit.

Another alternative embodiment of the present invention includes a kit comprising a combination of a puzzle and greeting card, the kit including: a plurality of panels for imprinting reference indicia thereon; each panel in the plurality of panels having an outer surface and an inner surface respectively; a lattice-like pattern imprinted on a first inner surface of at least one panel, the pattern having a plurality of reference numbers imprinted thereon at spaced, selectable loci of the pattern; the plurality of panels having substantially the same quadrilateral shape and approximately the same dimensions as each other, the plurality of panels each having a side edge thereof fixedly and pivotally connected to the side edge of an adjacent panel to form an openable greeting card; an array of legend indicia imprinted on a second inner surface of at least one panel thereof, the inner surface faces toward an inner surface of one of the plurality of panels when the greeting card is in its closed position in overlying fashion, the legend indicia defining instructions to complete the lattice-like pattern of the first inner surface; and an overlay panel including apertures selectively positioned such that upon overlaying the overlay panel over the lattice-like pattern, a message is revealed through the apertures from the indicia on the lattice-like pattern.

BRIEF DESCRIPTION OF THE DRAWINGS

FIG. 9 illustrates the kit having the overlay sheet covering the lattice-like pattern but revealing the hidden message for one puzzle of the present invention.

DETAILED DESCRIPTION OF THE PREFERRED EMBODIMENT

Figure 2:
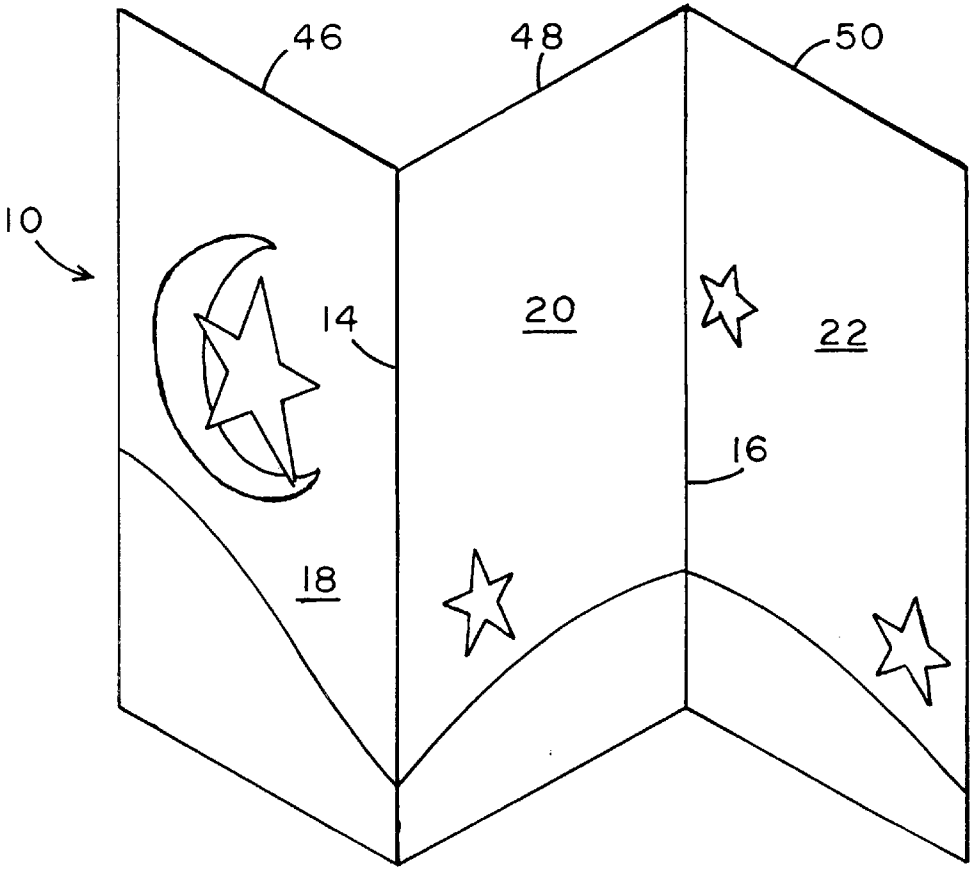
FIG. 2 is a perspective view of the outer surfaces of the panels.
Figure 1:
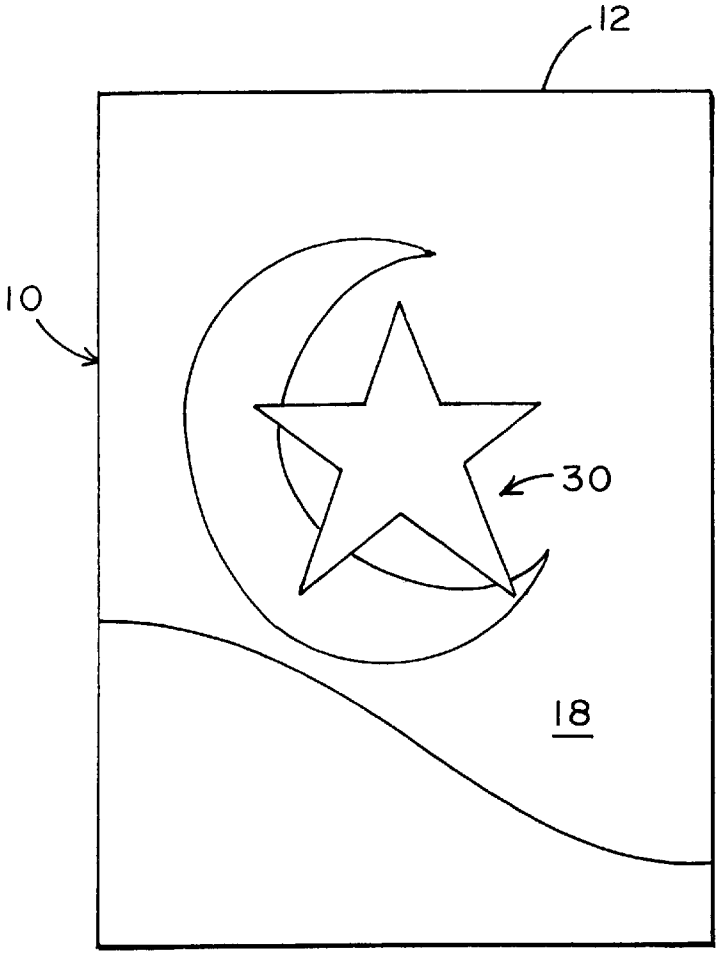
FIG. 1 is a view of a closed puzzle/greeting card kit according the present invention.

Referring now to the drawings, there is shown one preferred embodiment of the greeting card kit of the invention provided for illustrative purposes only and not to be construed in any limiting sense. As shown in FIGS. 1 and 2, the kit 10 illustrated includes a puzzle greeting card 12 formed as a sheet of paper or from cardboard, or the like, folded over upon itself, preferably along a plurality of hinge like fold lines 14 and 16 to form a plurality of panels for imprinting reference indicia thereon. The plurality of panels have substantially the same quadrilateral shape and approximately the same dimensions as each other. The plurality of panels each have a side edge thereof fixedly and pivotally connected to the side edge of an adjacent panel to form an openable greeting card.

Figure 3:
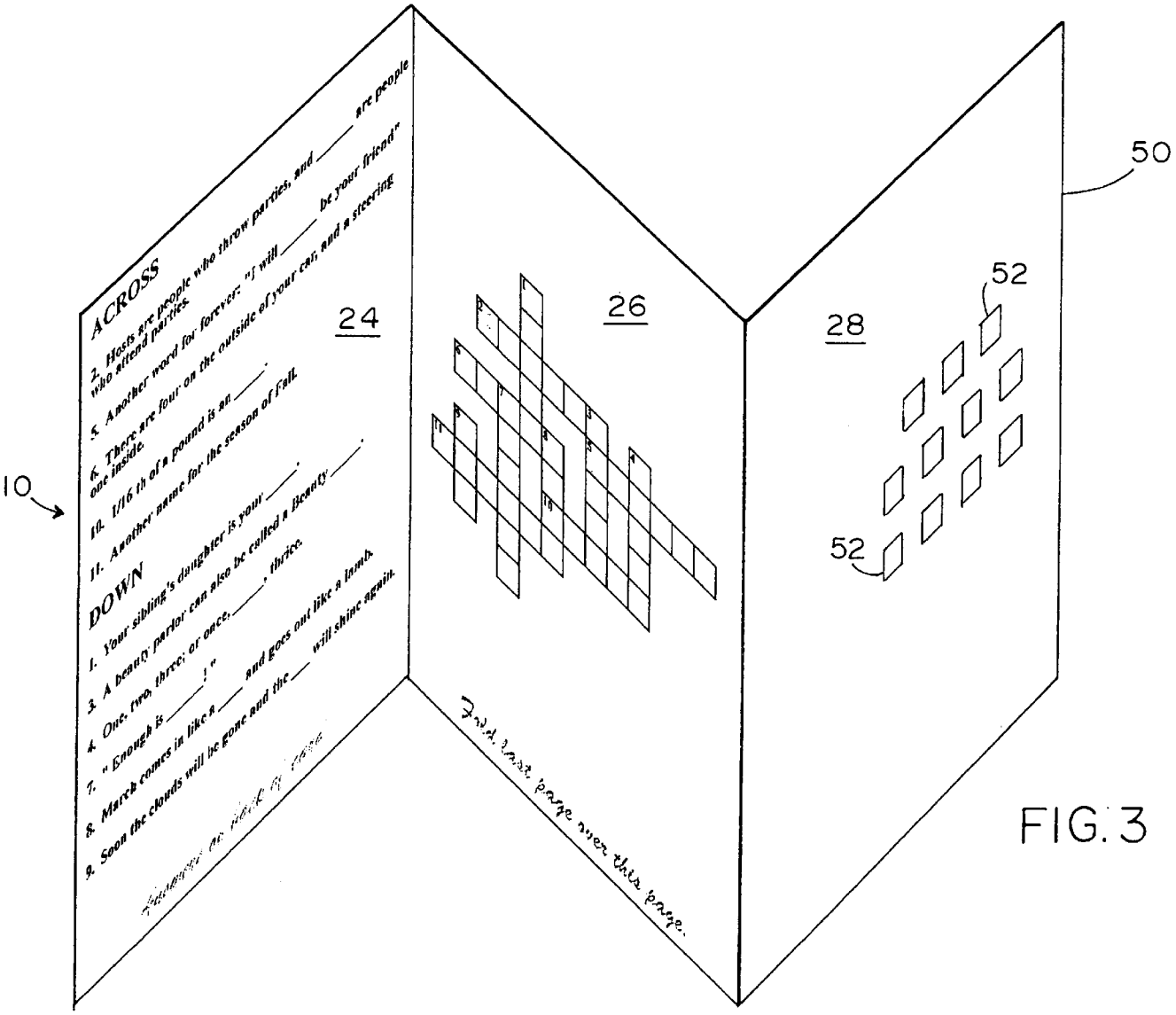
FIG. 3 is a perspective view of the inner surfaces of the panels.

Preferably, the folded card 12 forms a three panel structure 46, 48, 50 having outer or outside surfaces 18, 20, and 22 respectively, and corresponding inner or inside surfaces 24, 26 and 28, as shown in FIGS. 2 and 3. The inner surfaces face toward another inner surface of one of the plurality of panels when the greeting card is in its closed position in overlying fashion. The outer surface 18 of top panel 46 or cover panel 46 of the greeting card 12 may be decorated in any desired manner and style using any preferred art work either alone or in combination with printed matter. In a typical application of the invention, the greeting card will bear a general greeting on the outer surface 18. Although a greeting card of the present invention is particularly suitable for humorous cards, its use is not limited thereto. The card can be used as St. Valentine's day cards, for example, to send particularly romantic or private hidden messages. The cards may also be used for holidays, such as Christmas, or civic pride days in which the puzzle comprises hints and messages about a local area. The cover panel 46 may be imprinted with attractive art work 30 (see FIG. 1) and include an admonition or advice calling immediate attention to the unique nature of the puzzle/greeting card kit 10 being offered for sale. Panels 48 and 50 of the kit 10 may also include any art work or printed matter.

Figure 4:
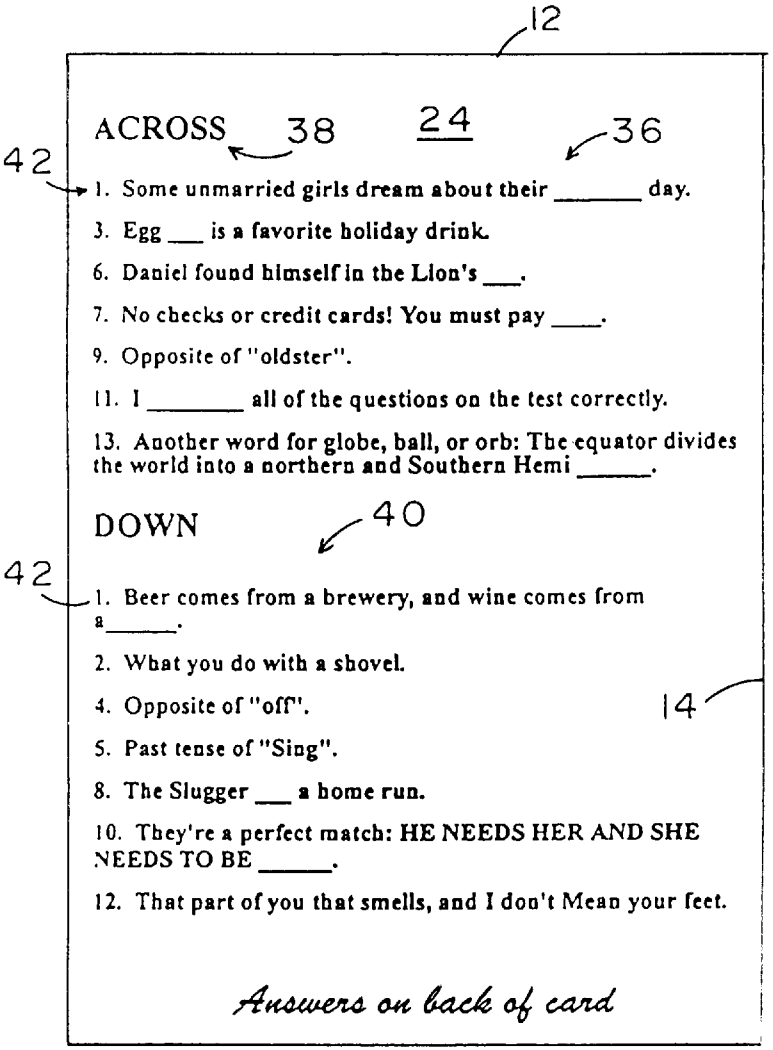
FIG. 4 shows legends for one puzzle of the present invention.
Figure 5:
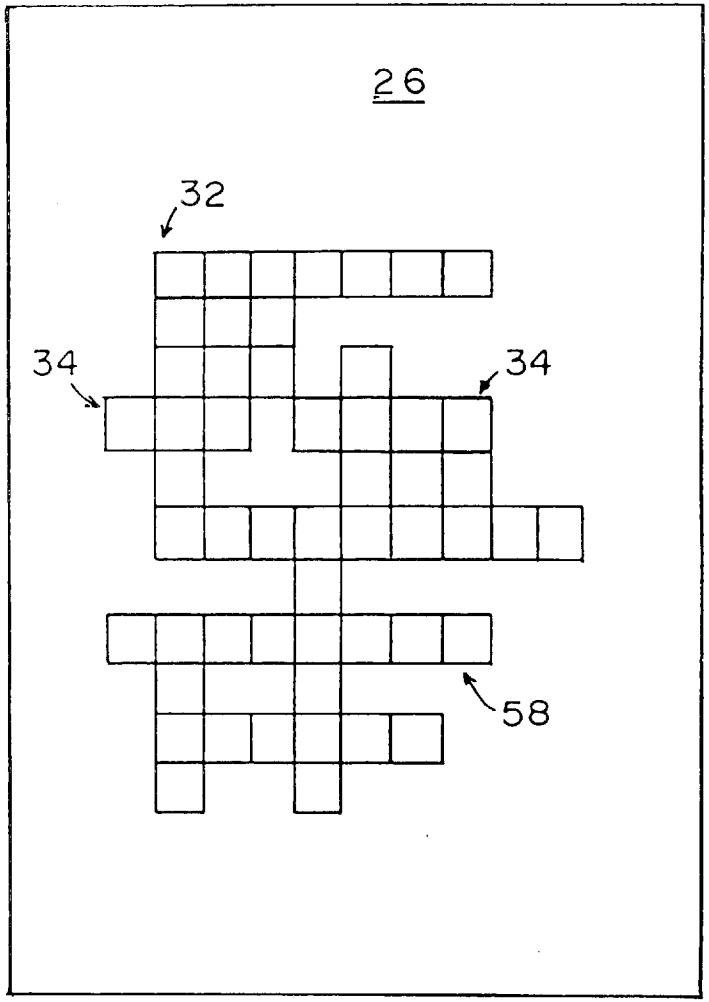
FIG. 5 shows a lattice-like pattern for one puzzle of the present invention.

The inside or inner surfaces 24, 26 and 28 of panels 46, 48, and 50 of the kit 10 are illustrated in FIGS. 3, 4 and 5. A crossword puzzle lattice-like pattern 32 is imprinted on a first inner surface of at least one panel, the pattern 32 having a plurality of reference numbers 34 imprinted thereon at spaced, selectable loci of the pattern 32. As shown, the inner surface 26 of panel 48 is preferably imprinted with the crossword puzzle lattice-like pattern 32 including a plurality of spaced reference numbers 34. The lattice-like pattern 32 or puzzle has as its solution a first plurality of words 58. The inner surface 26 faces toward an inner surface of one of the plurality of panels when the greeting card is in its closed position in overlying fashion.

An array of legend indicia 36 is preferably imprinted on a second inner surface of at least one panel of the plurality of panels. The legend indicia define instructions to complete the lattice-like pattern 32 of the first inner surface. Preferably, the inside surface 24 of cover panel 46 facing the lattice-like pattern 32 is imprinted with legends 36 arranged in "across" 38 and "down" 40 columns and numbers 42 in correspondence with the numbers 34 which appear on the crossword lattice-like pattern 32 itself. The legends 36 constitute the "clues" to be used in filling or "solving" the crossword lattice-like pattern 32.

Figure 6:
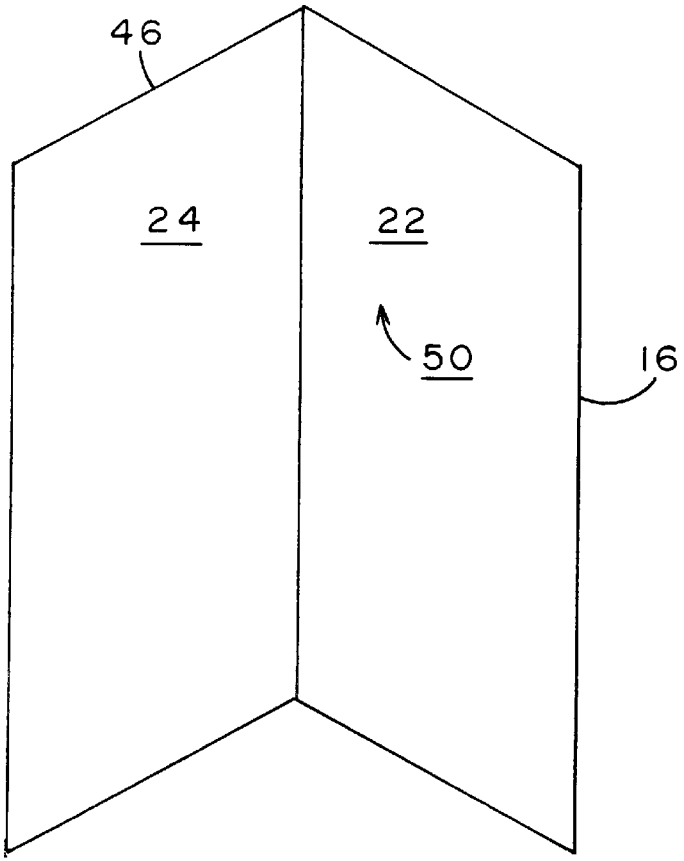
FIG. 6 illustrates the kit having the overlay sheet covering the lattice-like pattern for one puzzle of the present invention.

At the time of purchase of the puzzle/greeting card kit 10 of the invention, the lattice-like pattern 32 may be covered by the panel 50 or mask 50 which may be cardboard paper, tissue paper or similar sheet stock as the rest of the panels as shown in FIG. 6. The mask 50 may be attached to one side thereof of the panel 48 and folded in an outward motion along fold line 16 to reveal the lattice-like pattern 32. In this manner, there are no loose sheets of paper in the kit. In an alternative embodiment, the mask 50 may be removed or separated from the kit 10 along fold line 16. The mask 50 preferably includes a plurality of apertures 52 selectively positioned such that upon overlying the lattice-like pattern 32, a hidden message 44 is revealed to the recipient from the indicia on the lattice-like pattern 32. That is, the mask 50 reveals a plurality of letters 60 from the first plurality of words 58 for forming a greeting consisting of a second plurality of words 62 different from the first plurality of words 58.

Figure 10:
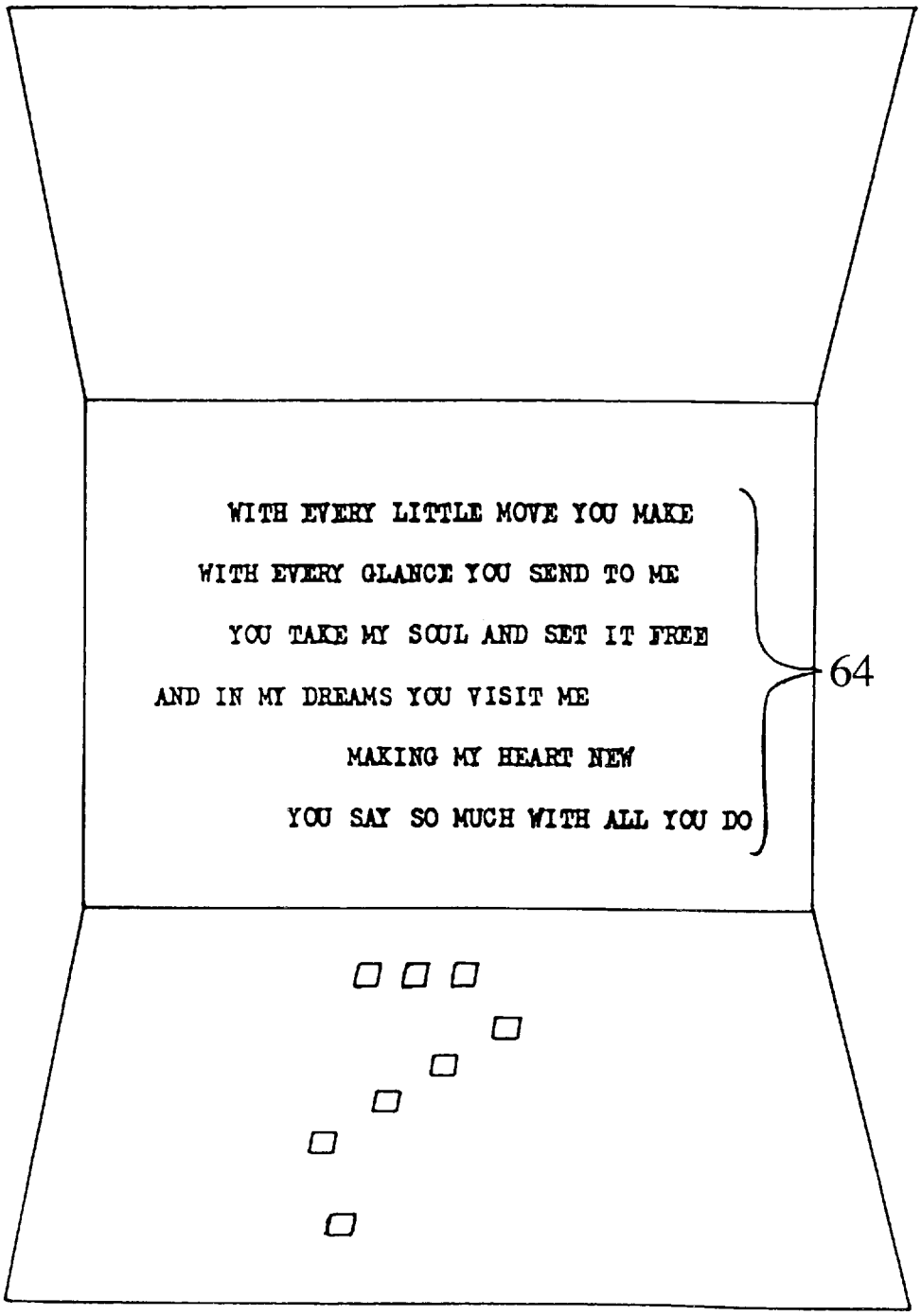
FIG. 10 shows an alternative embodiment of the present invention.

As an alternative embodiment of the invention, the first plurality of words may be included as part of the text of a poem, greeting or paragraph. As shown in FIG. 10, a puzzle would not be included in the kit. The first plurality of words would comprise a text of a poem, story, greeting or an appropriate paragraph.

Figure 7:
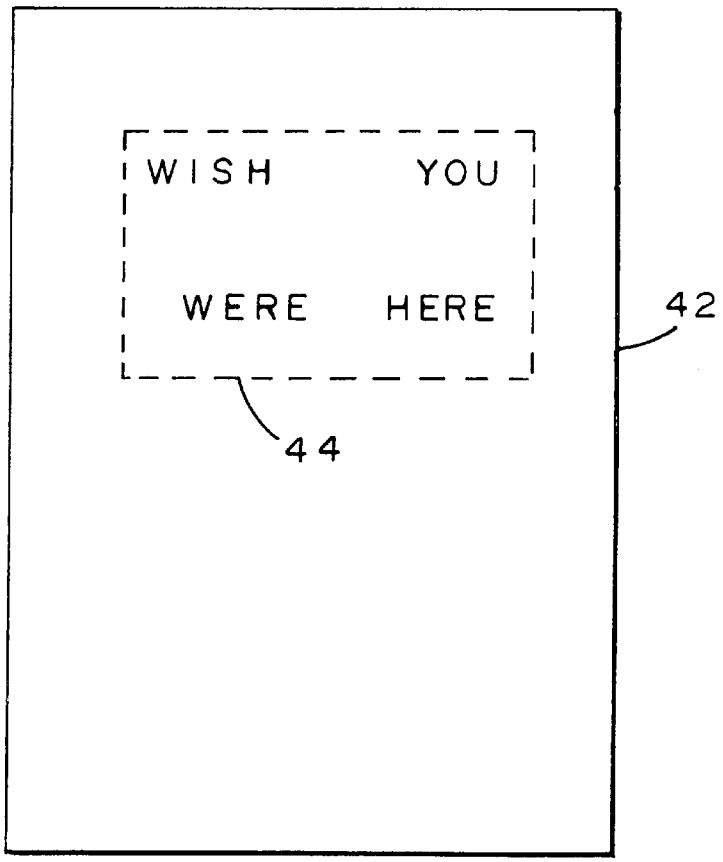
FIG. 7 illustrates an answer sheet for one puzzle of the present invention.

Preferably, at the time of purchase, the purchaser or the sender of the card removes an additional answer sheet 54 which may be included in the kit 10. As shown in FIG. 7, the hidden message 44 is revealed on the answer sheet 54 so that the sender of the card will know if the hidden message 44 is an appropriate message to send to a desired party. Alternatively, the hidden message 44 may be printed anywhere on the card 12.

Upon opening the folded card 12, a recipient of the puzzle/greeting card kit 10, preferably marketed as the WORD WEAVE, views the lattice-like pattern 32 and understands that he/she is to solve a crossword puzzle. He/she will proceed to solve the puzzle using the legends 36 which constitute the clues to be used in filling in the lattice-like pattern 32. Upon filling in the lattice-like pattern 32, the recipient will place the mask 50 having the plurality of apertures 52 over the lattice-like pattern 32 to reveal the hidden message 44 through the apertures 52, as shown in FIG. 9.

Figure 8:
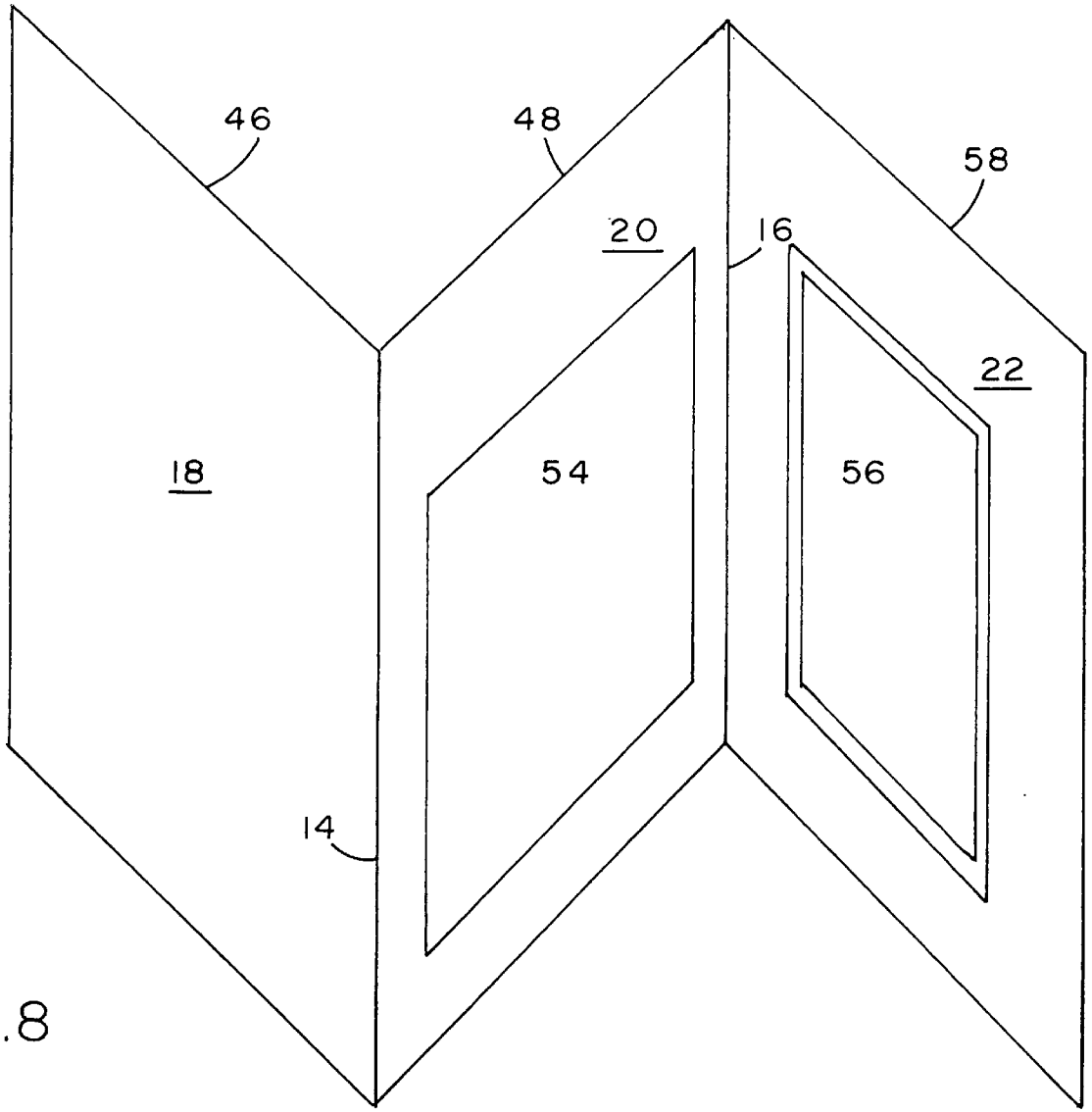
FIG. 8 illustrates the image transferable sheet and the message receiving sheet.

Referring to FIG. 8, in an alternative embodiment, image transferable substrates 56 or sections thereof, underlying predetermined cut out sections on the lattice-like pattern 32, transfer the image or marks imposed on the lattice-like pattern 32 to a message receiving sheet 58, which is positioned behind the lattice-like pattern 32. Preferably, the message receiving sheet 58 is the outer surface 22 of the panel 50. The panel 50 is folded behind the panel which has the lattice-like pattern imprinted on it; in this instance, the panel 50 is folded behind the panel 48 along fold line 16. The message receiving sheet may also be releasably attached to the outer surface 20 of panel 48. Upon completing the crossword puzzle, a recipient views the message receiving sheet 58 to determine the hidden message 44. The image transferable substrate 56 may be carbon paper, carbonless transfer paper, or any appropriate image transferable substrate known in the art.

While a preferred embodiment of the invention has been illustrated and described, other variations may be made utilizing the inventive concepts herein disclosed. The foregoing describes only some embodiments of the invention, and modifications which are obvious to those skilled in the art may be made thereto without departing from the scope of the invention as defined in the following claims.

I claim:

1. A kit comprising a combination of a puzzle and a greeting card, the kit including:

a plurality of panels for imprinting reference indicia thereon; each panel in the plurality of panels having an outer surface and an inner surface respectively;

a lattice-like pattern imprinted on a first inner surface of at least one panel, the pattern having a plurality of reference numbers imprinted thereon at spaced, selectable loci of the pattern;

the plurality of panels having substantially a same quadrilateral shape and approximately a same dimension as each other, the plurality of panels each having a side edge thereof fixedly and pivotally connected to the side edge of an adjacent panel to form an openable greeting card;

an array of legend indicia imprinted on a second inner surface of at least one panel thereof, the inner surface faces toward an inner surface of one of the plurality of panels when the greeting card is in its closed position in overlying fashion, the legend indicia defining instructions to complete the lattice-like pattern of the first inner surface; and a mask including apertures selectively positioned such that upon overlaying the mask over the lattice-like pattern, a message is revealed through the apertures.

2. The kit as defined in claim 1 in which the puzzle is a crossword puzzle.

3. The kit as defined in claim 1 in which the legend indicia are revealed in a proper sequence when the mask is placed over the lattice like pattern.

* * * * *